US007671879B2

(12) United States Patent
Tatewaki et al.

(10) Patent No.: US 7,671,879 B2
(45) Date of Patent: Mar. 2, 2010

(54) INFORMATION RECORDING APPARATUS

(75) Inventors: Tadafumi Tatewaki, Shizuoka (JP); Hideo Sakurai, Shizuoka (JP); Kazuhiro Tsuji, Mie (JP); Naoki Yoshida, Tokyo (JP)

(73) Assignees: Ricoh Company, Ltd., Tokyo (JP); Shinko Electric Co., Ltd., Tokyo (JP); Wedg Co., Ltd., Tokyo (JP)

( * ) Notice: Subject to any disclaimer, the term of this patent is extended or adjusted under 35 U.S.C. 154(b) by 0 days.

(21) Appl. No.: 12/205,372

(22) Filed: Sep. 5, 2008

(65) Prior Publication Data

US 2009/0066777 A1 Mar. 12, 2009

(30) Foreign Application Priority Data

Sep. 11, 2007 (JP) ..... 2007-235656

(51) Int. Cl.
*B65H 1/04* (2006.01)
*B41J 13/00* (2006.01)

(52) U.S. Cl. ..... 347/218

(58) Field of Classification Search ..... 347/104, 347/218

See application file for complete search history.

(56) References Cited

U.S. PATENT DOCUMENTS

| | | | | |
|---|---|---|---|---|
| 5,937,260 | A * | 8/1999 | Taninaka et al. | 399/401 |
| 6,579,826 | B2 | 6/2003 | Furuya et al. | |
| 6,818,591 | B2 | 11/2004 | Arai et al. | |
| 6,969,695 | B2 | 11/2005 | Kuboyama et al. | |
| 6,989,349 | B2 | 1/2006 | Tatewaki et al. | |
| 7,238,642 | B2 | 7/2007 | Shimbo et al. | |
| 2002/0041322 | A1 | 4/2002 | Miyoshi et al. | |
| 2005/0176582 | A1 | 8/2005 | Arai et al. | |
| 2006/0081696 | A1 | 4/2006 | Sakurai et al. | |
| 2006/0094599 | A1 | 5/2006 | Kuboyama et al. | |
| 2006/0104697 | A1 | 5/2006 | Meyerhofer | |
| 2007/0236718 | A1 | 10/2007 | Yokomura et al. | |
| 2007/0268319 | A1 | 11/2007 | Tatewaki et al. | |
| 2008/0062236 | A1 | 3/2008 | Sakurai et al. | |
| 2008/0062237 | A1 | 3/2008 | Sakurai et al. | |

FOREIGN PATENT DOCUMENTS

| | | |
|---|---|---|
| EP | 1 304 305 A2 | 4/2003 |
| EP | 1 304 305 A3 | 4/2003 |
| EP | 1 398 158 A1 | 3/2004 |
| JP | 6-171767 | 6/1994 |

(Continued)

*Primary Examiner*—Huan H Tran
(74) *Attorney, Agent, or Firm*—Oblon, Spivak, McClelland, Maier & Neustadt, L.L.P.

(57) ABSTRACT

An information recording apparatus enables information to be recorded in a thermosensitive recording medium accurately while preventing the development of skew. When a rewritable medium is conveyed to a recording unit, the rotation of the rewritable medium and its position with reference to an axis are adjusted. Specifically, the rewritable medium is held between guide pins to such an extent as not to warp the rewritable medium while the medium is sandwiched between a clamper and a conveyance tray, until the rewritable medium reaches the recording unit. Thus, the rewritable medium is delivered to the recording unit with an adjusted posture, allowing the recording unit to record information in the rewritable medium without the development of skew in the rewritable medium.

7 Claims, 7 Drawing Sheets

FOREIGN PATENT DOCUMENTS

| | | |
|---|---|---|
| JP | 2002-234201 | 8/2002 |
| JP | 2005-225043 | 8/2005 |
| JP | 2006-27216 | 2/2006 |
| JP | 2007-21928 | 2/2007 |
| WO | WO 03/048014 A1 | 6/2003 |

* cited by examiner

INFORMATION RECORDING APPARATUS

BACKGROUND OF THE INVENTION

1. Field of the Invention

The present invention generally relates to information recording apparatuses, and more particularly to an information recording apparatus for recording information in a recording medium.

2. Description of the Related Art

With the growing awareness for environmental protection and recycling in recent years, attention is being focused on a rewritable medium capable of repeatedly recording and erasing information. An example of the rewritable medium is a thermosensitive recording medium comprising a substrate that is coated with a leuco dye and an oxidizing substance in order to form a recording layer thereon having thermal reversibility. Application of appropriate heat can cause the recording layer to relatively exhibit or lose a color. Because a thermal printer required for recording information in such a rewritable medium has a relatively simple structure and is easy to maintain, the thermal printer is expected to increase its share, possibly replacing the laser printers based on the Carlson process.

In the above thermal printer, generally, information is first erased with an erasing unit while the rewritable medium is moved on conveyance rollers, and new information is then recorded with a recording unit, as described in Japanese Laid-Open Patent Application No. 2002-234201, which discloses a recording apparatus.

The present inventors have considered the viability of putting a novel thermal printer in the market in which the recording unit and the erasing unit are arranged vertically in order to allow a full-front operation by a user. An analysis indicated that in this type of a thermal printer, a lifter or the like equipped with a lifting tray could be advantageously employed to convey a rewritable medium from the erasing unit to the recording unit.

However, conveyance using a lifter is associated with a possible problem of skew during recording of information, which may be caused when the rewritable medium from which information has been erased is placed on the lifting tray in an inclined manner with respect to the recording unit for one reason or another. Because the rewritable medium is used over and over, the medium may become curled after a repeated use, thus increasing the frequency and degree of skew during recording.

SUMMARY OF THE INVENTION

It is a general object of the present invention to provide a novel and useful information recording apparatus in which one or more of the aforementioned problems are eliminated. A more specific object is to provide an information recording apparatus in which the tilting of a thermosensitive recording medium with respect to a moving body for conveying the thermosensitive recording medium is either eliminated or reduced, so that the thermosensitive recording medium can be supplied to a recording unit with no or reduced tilting, thus allowing for an accurate recording of information with no skew.

In one aspect, the invention provides an information recording apparatus for recording information in a thermosensitive recording medium that exhibits and loses a color in a thermally reversible manner. The information recording apparatus comprises an erasing unit configured to erase information recorded in the thermosensitive recording medium; a recording unit configured to record information in the thermosensitive recording medium from which information is erased by the erasing unit; a moving body configured to move between the erasing unit and the recording unit with the thermosensitive recording medium placed on the moving body; and a skew adjusting mechanism configured to eliminate or reduce a tilting of the thermosensitive recording medium placed on the moving body with respect to the moving body.

In a preferred embodiment, the skew adjusting mechanism includes a first abutting portion that moves relative to the moving body and abuts on an outer edge of the thermosensitive recording medium at least on one side thereof, in order to eliminate or reduce the tilting of the thermosensitive recording medium with respect to the moving body.

In another preferred embodiment, the skew adjusting mechanism includes a second abutting portion that abuts on an outer edge of the thermosensitive recording medium on the other side thereof in order to eliminate or reduce the tilting of the thermosensitive recording medium with respect to the moving body.

Another embodiment may further comprise a driven portion that moves with the moving body; a guide portion configured to move the driven portion relative to the moving body while changing the direction of movement of the driven portion when the moving body moves near the erasing unit or the recording unit; and a driven section configured to move the abutting portion in accordance with the movement of the driven portion.

Another preferred embodiment may further comprise a medium pressing mechanism configured to press the thermosensitive recording medium onto the moving body.

In a preferred embodiment, the medium pressing mechanism includes an up/down portion configured to, in mechanical linkage with the movement of the driven portion relative to the moving body, assume a spaced-apart posture in which the up/down portion is spaced apart from the moving body, or a pressing posture in which the up/down portion presses the thermosensitive recording medium onto the moving body. The up/down portion assumes the pressing posture when the moving body is conveyed from the erasing unit to the recording unit.

In another aspect, the invention provides an information recording apparatus for recording information in a sheet-like recording medium. The information recording apparatus comprises a recording unit configured to record information in the recording medium; a moving body configured to move from a predetermined position to the recording unit with the recording medium placed on the moving body; and a skew adjusting mechanism configured to eliminate or reduce a tilting of the recording medium placed on the moving body with respect to the moving body.

BRIEF DESCRIPTION OF THE DRAWINGS

These and other objects, features and advantages of the invention will be apparent to those skilled in the art from the following detailed description of the invention, when read in conjunction with the accompanying drawings in which.

DETAILED DESCRIPTION OF THE PREFERRED EMBODIMENTS

Figure 1:
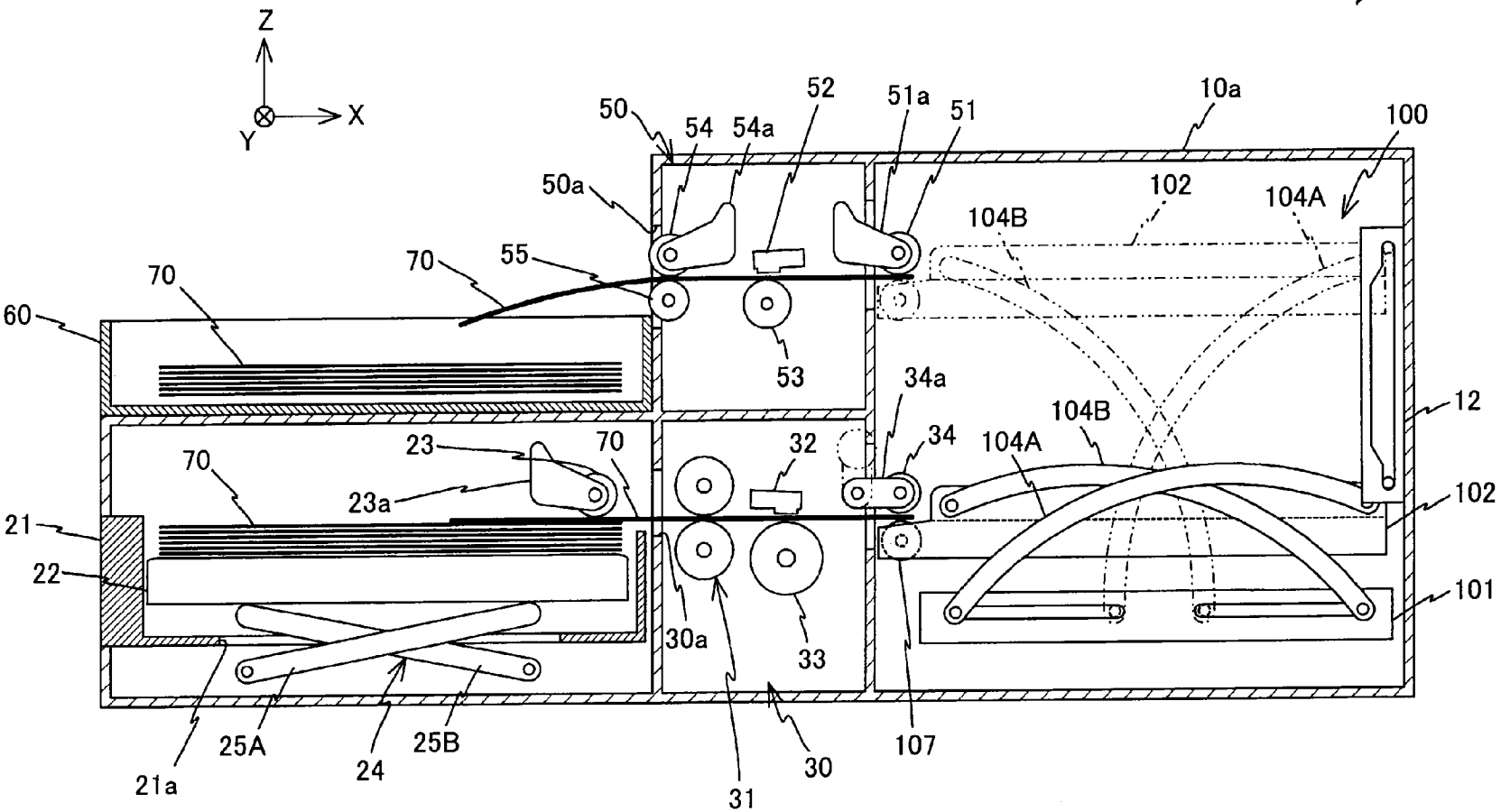
FIG. 1 schematically shows a printer according to an embodiment of the invention.

An embodiment of the present invention is described with reference to FIGS. 1 through 8B. FIG. 1 is a schematic view of a printer 10 as an information recording apparatus according to an embodiment of the present invention. The printer 10 is a thermal printer configured to erase and record information from and in a rewritable medium 70, which is an example of a thermosensitive recording medium. As shown in FIG. 1, the printer 10 includes an erasing unit 30, a recording unit 50, a conveying device 100, a paper feeding cassette 21, a lifting mechanism 24, a paper feeding roller 23, a paper discharge tray 60, and a casing 10*a* in which the aforementioned individual units are housed.

Figure 2:
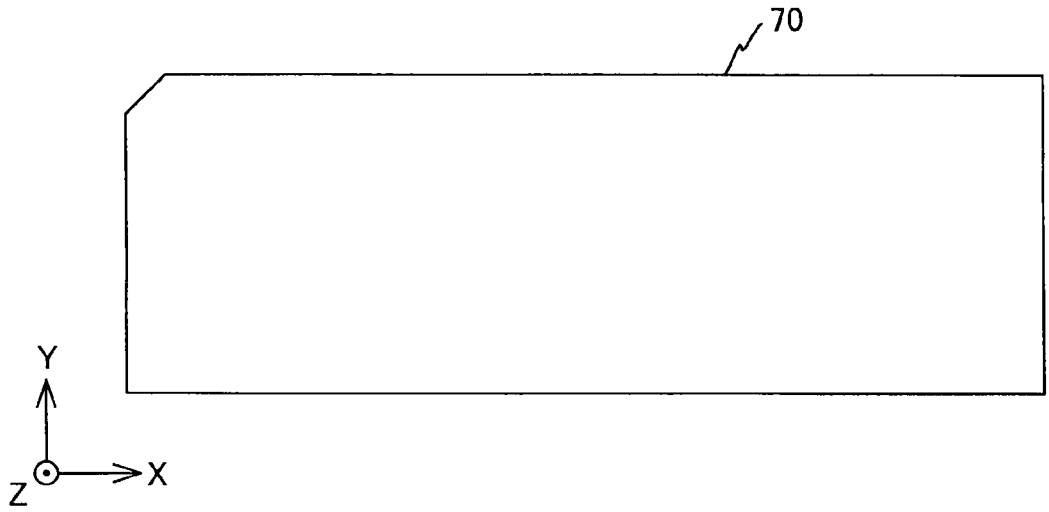
FIG. 2 is a plan view of an example of a rewritable medium.

FIG. 2 is a plan view showing the rewritable medium 70. As shown in FIG. 2, the longitudinal direction of the rewritable medium 70 lies in an X-axial direction. The rewritable medium 70 includes a base substrate and a recording material affixed to an upper surface (a+Z side) of the base material.

Figure 3:
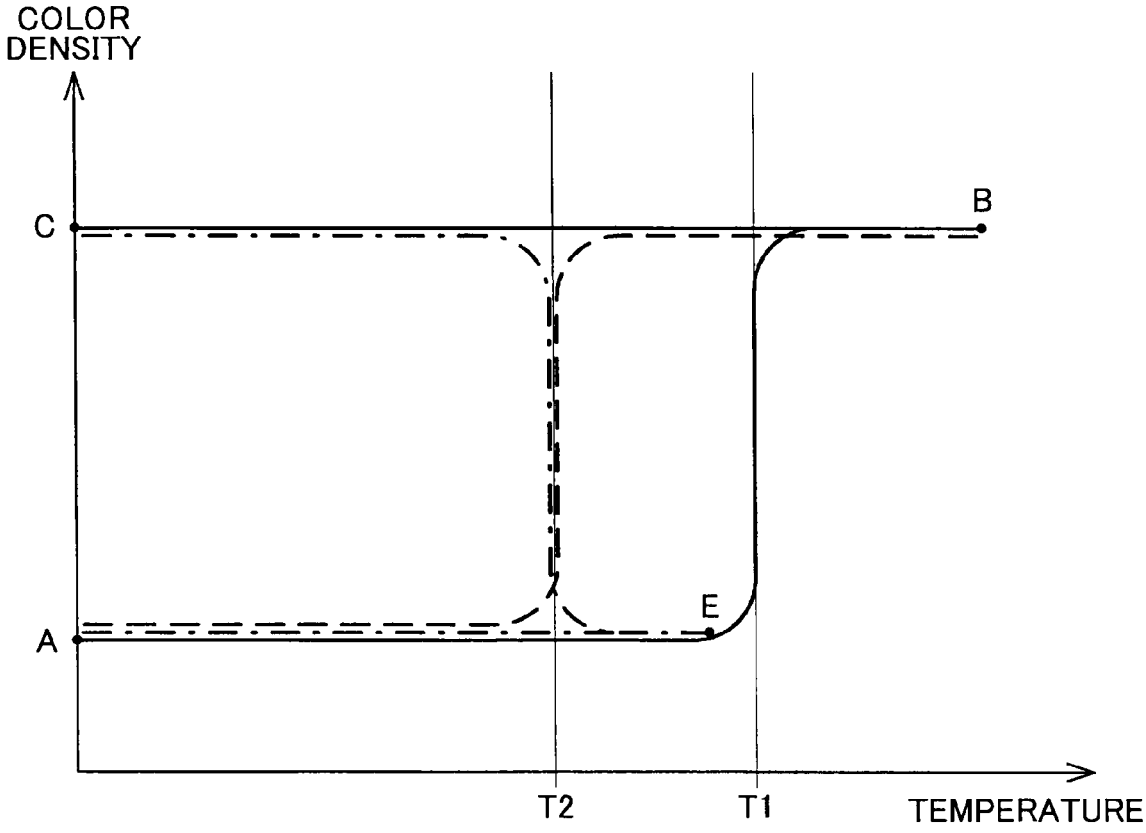
FIG. 3 shows a graph indicating the temperature characteristics of the rewritable medium shown in FIG. 2.

The recording material is a reversible thermosensitive recording medium capable of exhibiting and losing a color with the use of a thermal head. A relatively colored state can be obtained based on a difference in heating temperatures and cooling rates after heating. FIG. 3 is a graph showing the relationship between temperature and color density in this recording material (temperature characteristics). As shown in FIG. 3, as the temperature of the thermosensitive recording medium in a discolored state A is increased, coloring starts in the vicinity of temperature T1 along the solid line in the graph. When the temperature reaches T1, the thermosensitive recording medium is in a colored state B. Upon rapid cooling from the colored state B, the thermosensitive recording medium transitions to a colored state C along a solid line in the graph, in which the colored state is maintained even at room temperature. When the thermosensitive recording medium in the colored state B is gradually cooled, as shown by a dashed line in the graph, discoloring occurs during gradual cooling and the thermosensitive recording medium returns to the discolored state A. On the other hand, when the temperature of the thermosensitive recording medium in the colored state C is increased again, as shown by a one dotted line, discoloring occurs at a temperature T2 lower than the temperature T1, so that the thermosensitive recording medium transitions to a discolored state E. By reducing the temperature from the discolored state E, the thermosensitive recording medium returns to the discolored state A. Thus, by heating the upper surface of the rewritable medium 70 with the thermal head, information can be erased or recorded.

Referring back to FIG. 1, the paper feeding cassette 21 is a box-shaped member that has an open upper end and an opening 21*a* in a bottom wall. A tray 22 is configured to move in the Z axial direction inside the paper feeding cassette 21. Sheets of the aforementioned rewritable medium 70 are mounted on the tray 22 with the longitudinal direction of the rewritable medium 70 lying in the X axis direction. When the paper feeding cassette 21 is inserted into the casing 10*a*, the tray 22 is biased by the lifting mechanism 24 in an upper direction via the opening 21*a* of the paper feeding cassette 21. The lifting mechanism 24 has a pair of bar members 25A and 25B that are rotatably attached at their −X side end and +X side end, respectively, so that the bar members 25A and 25B can rotate up and down about an axis parallel to the Y-axis. Under this structure, the upper-most sheet of the rewritable medium 70 mounted on the tray 22 is pressed upon by a lower surface of the paper feeding roller 23 supported by the supporting member 23*a*. As the paper feeding roller 23 rotates, the rewritable medium 70 is supplied inside the erasing unit 30 via an insertion opening 30*a*.

The erasing unit 30 includes a pair of conveyance rollers 31 for conveying the rewritable medium 70 as it is sent from the paper-feeding cassette 21 one sheet after another; an erasing head 32 disposed on the +X side of the conveyance roller pair 31; a platen roller 33 disposed under the erasing head 32; and a movable roller 34 disposed via a movable member 34*a*.

In the erasing unit 30, as the rewritable medium 70 is moved in the +X direction by the conveyance rollers 31, the erasing head 32 comes in contact with an upper surface of the rewritable medium 70 supported from below by the platen roller 33. By heating the upper surface of the rewritable medium 70 using the erasing head 32 to a temperature equal to or greater than the temperature T2 indicated in FIG. 3, the information recorded in the rewritable medium 70 is erased.

The recording unit 50 is provided above (on the +Z side) the erasing unit 30. The recording unit 50 includes a recording head 52, a platen roller 53, a drawing roller 51, and first and second discharge rollers 54 and 55. The recording head 52 is supported by a supporting member not shown in FIG. 1 so as to be able to be lifted. The platen roller 53 is provided below the recording head 52. The drawing roller 51 is provided on the +X side of the recording head 52. The drawing roller 51 draws the rewritable medium 70, as it is conveyed from the erasing unit 30 by the conveyance device 100, between the recording head 52 and the platen roller 53. The first and second discharge rollers 54 and 55 are provided on the −X side of the recording head 52 adjacent to each other in upper and lower directions.

In the recoding unit 50, as the −X side end of the rewritable medium 50 is drawn between the recording head 52 and the platen roller 53, the recording head 52 comes in contact with the upper surface of the recording head 70 supported from below by the platen roller 53, and the upper surface of the rewritable medium 70 is heated to a temperature equal to or greater than the temperature T1 while the rewritable medium 70 is sent in the −X direction by the platen roller 53, thereby recording the information.

The drawing roller 51 and the first discharge roller 54 are disposed via supporting members 51*a* and 54*a*, respectively, which can be moved in upper and lower directions by a driving mechanism not shown in FIG. 1. The drawing roller 51 and the first discharge roller 54 are situated in positions where they do not interfere with the rewritable medium 70 during printing. When printing of information is finished, the first discharge roller 54 comes in contact with the upper surface of the rewritable medium 70 so that the rewritable medium 70 is sandwiched between the first and second discharge rollers 54 and 55, and then the second discharge roller 55 is rotated. As a result, the rewritable medium 70 is ejected successively to the paper discharge tray 60 via a discharge opening 50*a* formed in the casing 10*a*.

Figure 4:
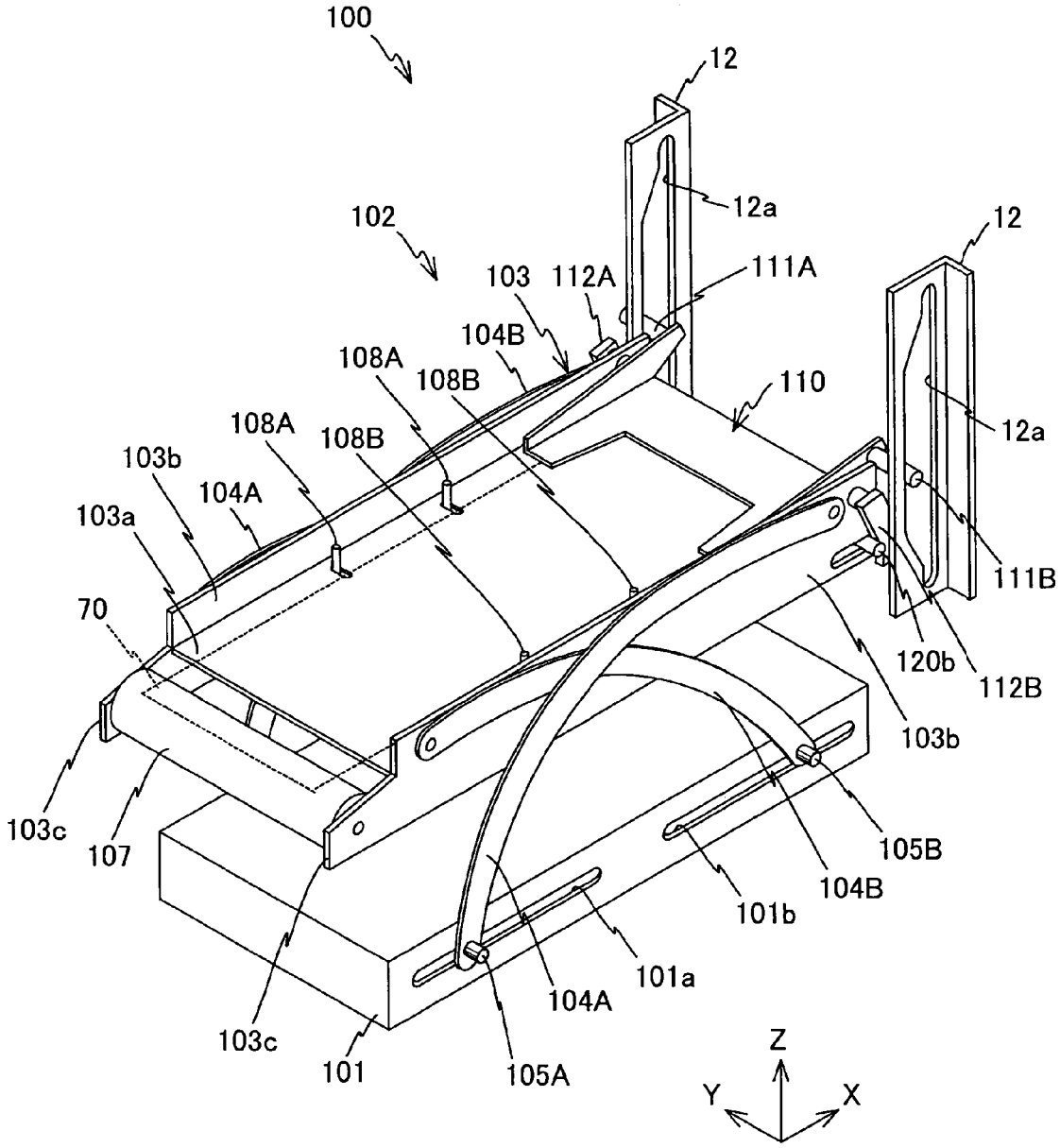
FIG. 4 shows a perspective view of a conveyance device.

FIG. 4 is a perspective view of a conveying device 100. As shown in FIG. 4, the conveying device 100 includes a box-shaped lifting device 101, a lifter 102 coupled with the lifting device 101 via a pair of link bars 104A and another pair of link bars 104B, and a pair of guides 12 engaged with the lifter 102.

The lifting device 101, which has its longitudinal direction in the X axis direction, is disposed inside the casing 10*a* via a support member which is not shown. On the surface of the lifting device 101 on the −Y side, there are provided a moving shaft 105A and a moving shaft 105B. The moving shaft 105A moves in a guide opening 101*a* extending from a −X side end to a center portion of the lifting device 101 in the X-axis direction. The moving shaft 105B moves in a guide opening 101*b* extending from a +X side end to the center portion in the X-axis direction. Similarly, on the +Y side of the lifting device 101, there are provided corresponding guide openings 101*a* and 101*b* and moving shafts 105A and 105B, which are not visible because they are on the other side of the lifting device 101. The moving shafts 105A and 105B on the +Y side and the moving shafts 105A and 105B on the −Y side are adapted to move in a synchronized manner in the +X direction and −X direction by a drive mechanism which is not shown.

Figure 5:
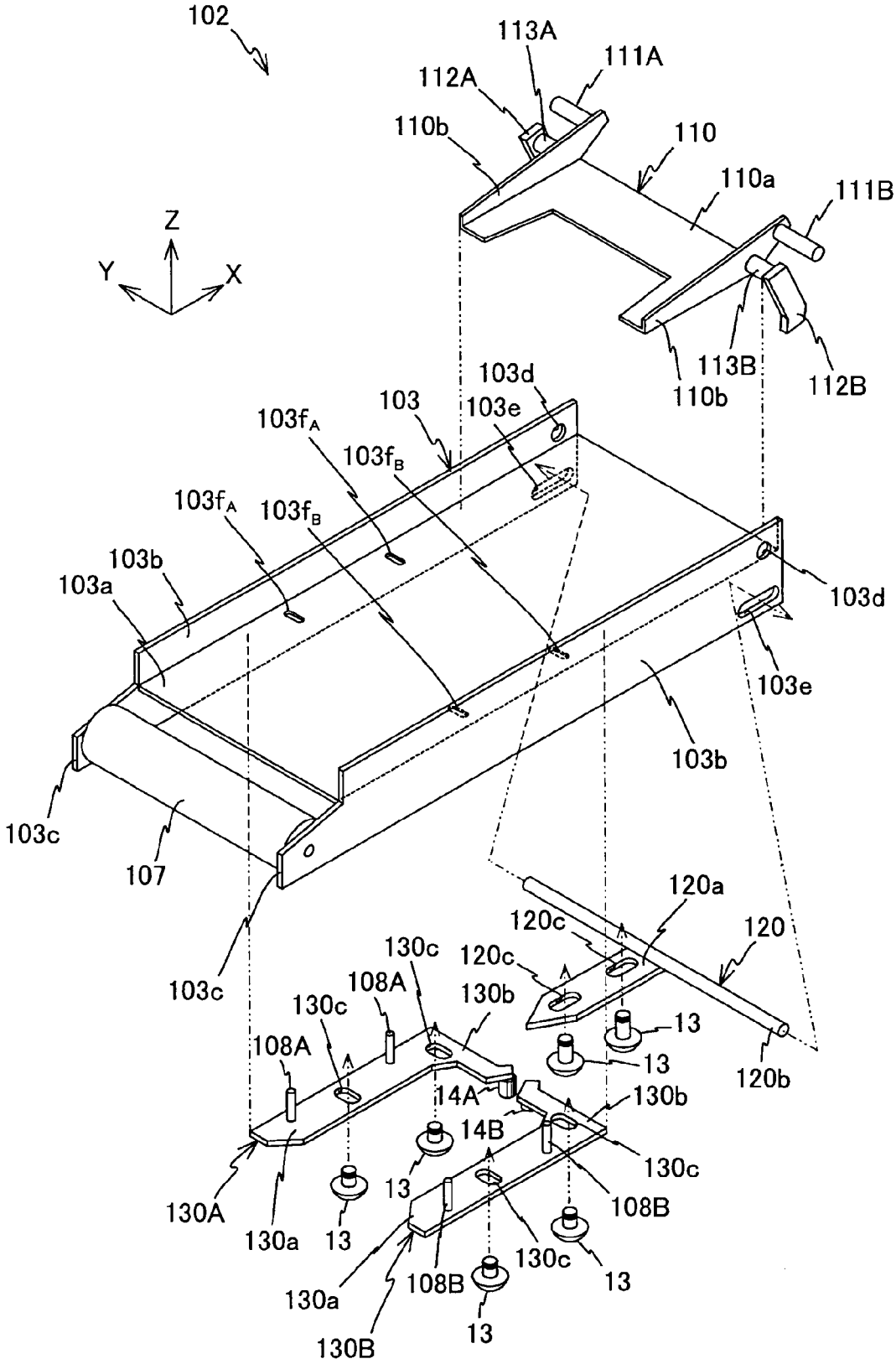
FIG. 5 shows an exploded perspective view of the conveyance device shown in FIG. 4.

FIG. 5 shows an exploded perspective view of the lifter 102. As shown, the lifter 102 includes a conveyance tray 103 as a moving body; a loading/unloading roller 107 attached to the conveyance tray 103; a clamper 110 as an up/down unit; an opening/closing member 120 as a driven section; and a pair of sliding members 130A and 130B.

The conveyance tray 103 has its longitudinal direction lying in the X-axis direction and has an H-shaped cross section in the Z-Y plane. The conveyance tray 103 includes a rectangular mount portion 103*a*, a pair of frame portions 103*b*, and a pair of roller support portions 103*c*. The mount portion 103*a* has the longitudinal direction in the X-axis direction. The frame portions 103*b* are disposed on the −Y side end and the +X-side end of the mount portion 103*a* in such a manner as to be perpendicular to the upper surface of the mount portion 103*a*. Each of the roller support portions 103*c* extends from the −X side end of each frame portion 103*b* in the −X direction.

The mount portion 103*a* has two guide openings 103$f_A$ formed on the +Y side end at a certain interval in the X-axis direction, the guide openings 103$f_A$ having the longitudinal direction in the Y-axis direction. Similarly, there are formed on the −Y side end two guide openings 103$f_B$ having the longitudinal direction in the Y-axis direction, at a certain interval in the X-axis direction. Each of the frame portions 103*b* has, on the +X side end thereof, an elongated opening 103*e* near a lower corner having the longitudinal direction in the X-axis direction, and a circular opening 103*d* near an upper corner.

The +Y side end and −Y side end of the loading/unloading roller 107 are rotatably supported by the roller support portions 103*c* of the conveyance tray 103 so that the upper surface of the loading/unloading roller 107 is substantially level with the upper surface of the mount portion 103*a*. The loading/unloading roller 107 can be rotated by a drive mechanism (not shown) in a normal direction about an axis parallel to the Y axis (clockwise direction in FIG. 1) and in a reverse direction (i.e., anticlockwise direction in FIG. 1).

The opening/closing member 120 is a T-shaped member including a cylindrical slide shaft 120*b* and a plate-like open/close portion 120*a*. The slide shaft 120*b* has the longitudinal direction in the Y-axis direction. The open/close portion 120*b*, of which a +X side end is fixed to a center portion of the slide shaft 120*b*, has the longitudinal direction in the Y-axis direction. The open/close portion 120*a* has its −X side end formed in a wedge shape, with the width decreasing in the −X direction. Two elongated openings 120*c* are formed in the open/close portion 120*a* at a certain interval in the X-axis direction, having the longitudinal direction in the X-axis direction.

The ends of the slide shaft 120*b* are inserted in the elongated openings 103*e* of the frame portions 103*b* of the conveyance tray 103. Screws 13 are threaded into the lower surface (on the −Z side) of the mount portion 103*a* from below via the elongated openings 120*c*. Thus, the opening/closing member 120 is attached to the conveyance tray 103 in such a manner as to be movable in the X-axis direction, as indicated by arrows in FIG. 6.

Each of the sliding members 130A and 130B, which have corresponding structures, is an L-shaped member that includes a sliding portion 130*a* having the longitudinal direction in the X-axis direction, and an extended portion 130*b* having the longitudinal direction in the Y-axis direction. The sliding portion 130*a* of each of the sliding members 130A and 130B has elongated openings 130*c* formed at a certain interval in the X-axis direction and having the longitudinal direction in the Y-axis direction. On the upper surface of the sliding member 130A, there are formed two cylindrical guide pins 108A as abutting portions having the longitudinal direction in the Z-axis direction, the guide pins 108A being fixed at a certain interval in the X-axis direction. On the upper surface of the sliding member 130B, there are formed two cylindrical guide pins 108B as abutting portions having the longitudinal direction in the Z-axis direction and fixed at a certain interval in the X-axis direction. At the −Y side end of the extended portion 130*b* of the sliding member 130A, there is attached a roller 14A rotatable about an axis parallel to the Z-axis. At the +Y side end of the extended portion 130*b* of the sliding member 130B, there is attached a roller 14B rotatable about an axis parallel to the Z-axis.

The screws 13 are threaded into the lower surface of the mount portion 103*a* of the conveyance tray 103 from below via the elongated openings 130*c*, with the two guide pins 108A of the sliding portion 130*a* inserted into the two guide openings 103$f_A$ formed in the mount portion 103*a*. Thus, the sliding member 130A is attached to the lower side of the mount portion 103*a* slidably in the Y-axis direction, as indicated by arrows in FIG. 6. The sliding member 130B is similarly attached to the conveyance tray 103 slidably in the Y-axis direction, as indicated by arrows in FIG. 6, by threading the screws 13 into the lower surface of the mount portion 103*a* from below via the elongated openings 130*c*, with the two guide pins 108B on the sliding portion 130*a* being inserted in the two guide openings 103$f_B$ formed in the mount portion 103*a*.

Figure 6:
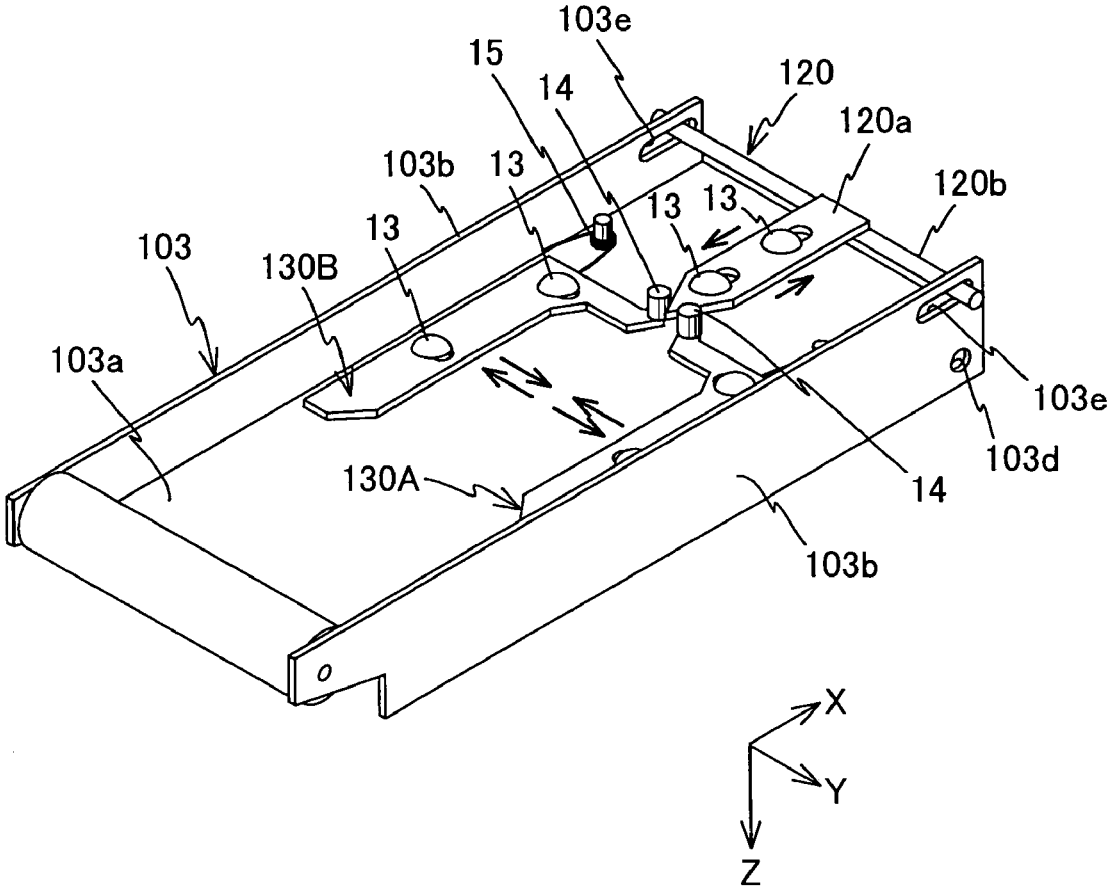
FIG. 6 shows a perspective view of an opening/closing member and sliding members attached to a conveyance tray.

The sliding member 130A attached to the conveyance tray 103 is biased toward the −Y direction by a spring 15 provided on the mount portion 103*a* of the conveyance tray 103. The sliding member 130B is biased toward the +Y direction by another spring 15. Thus, the sliding members 130A and 130B are disposed the closest to each other when positioned to the +Y side and the −Y side, respectively, maximally within their respective movable ranges, as shown in FIG. 6. In this state, the rollers 14A and 14B are respectively positioned in the vicinity of the −X side end of the open/close portion 120*a* of the opening/closing member 120 that is positioned on the +X side maximally in its movable range.

Thus, when the opening/closing member 120 is pushed in the −X direction, the −X side end of the open/close portion 120*a* of the opening/closing member 120 enters between the rollers 14A and 14B, thereby causing the sliding members 130A and 130B to slide toward the +Y direction and the −Y direction, respectively. When the pressing force applied to the opening/closing member 120 is lifted, the sliding members 130A and 130B slide back toward the −Y direction and the +Y direction, respectively, due to the resilience of the springs 15, thereby moving the opening/closing member 120 toward the +X direction.

The clamper 110 may be formed by sheet processing of a metal plate. The clamper 110 includes a U-shaped clamp portion 110*a*, and substantially triangular sidewall portions 110*b* disposed on the +Y side end and the −Y side end of the clamp portion 110*a*. Each of the sidewall portions 10*b* has on its +X side end a slide shaft 111A or 111B as cylindrical driven portions, protruding in the +Y direction or the −Y direction. At a position corresponding to the +X side end of the clamp portion 110*a*, there are attached cylindrical rotating shafts 113A and 113B having the longitudinal direction in the Y-axis direction, protruding in the +Y direction and the −Y direction, respectively. At the +Y side end and the −Y side end of the rotating shafts 113A and 113B, there are fixed rotating members 112A and 112B, respectively, having the longitudinal direction in the Z-axis direction.

The thus constructed clamper 110 is rotatably attached to the mount portion 103*a* of the conveyance tray 103, as shown in FIG. 4, by fixing the rotating shafts 113A and 113B to the sidewall portions 110*b* of the clamper 110 via the circular opening 103*d* formed in each of the frame portions 103*b*, with the lower surface of the clamp portion 110*a* being biased against the upper surface of the mount portion 103*a* of the conveyance tray 103. In this state, the lower-end portion of the rotating members 112A and 112B abuts on the slide shaft 120*b* of the opening/closing member 120 that protrudes from the elongated openings 103*e* in the conveyance tray 103.

Each of the link bars 104A is curved upwardly, as shown in FIG. 4, and disposed on the +Y side or the −Y side of the lifting device 101 and the conveyance tray 103. The +X side end of each of the link bars 104A is attached to an upper portion on the +X side end of the frame portion 103*b* of the conveyance tray 103 rotatably about an axis parallel to the Y axis. The −X side end of each of the link bars 104A is attached to the moving shaft 105A provided in the lifting device 101 rotatably about an axis parallel to the Y axis. Each of the pair of link bars 104B also has a corresponding structure to the link bars 104A, with the −X side end attached to an upper portion on the −X side end of the frame portion 103*b* of the conveyance tray 103 rotatably about an axis parallel to the Y axis, and the +X side end attached to the moving shaft 105B provided in the lifting device 101 rotatably about an axis parallel to the Y axis.

In the aforementioned conveyance device 100, when the moving shaft 105A is moved in the −X direction and the moving shaft 105B is moved in the +X direction by the lifting device 101, the conveyance tray 103 is lowered and positioned as indicated by the solid lines in FIG. 1. When the moving shaft 105A is moved in the +X direction and the moving shaft 105B is moved in the −X direction by the lifting device 101, the conveyance tray 103 is lifted and positioned as indicated by the virtual lines in FIG. 1. In the following, for the sake of explanation, the position of the conveyance tray 103 indicated by the solid lines in FIG. 1 is defined as a loading position, while the position of the conveyance tray 103 indicated by the virtual lines in FIG. 1 is defined as an unloading position.

Referring back to FIG. 4, the pair of guides 12 have L-shaped cross section in the X-Y plane and are disposed with their longitudinal directions in the Z-axis direction. As shown in FIG. 4, each guide 12 has a guide opening 12*a* of which a center portion is extended on the −X side in a plane parallel to the Z-X plane, compared with its upper-end portion and lower-end portion. With the slide shafts 111A and 111B of the lifter 102 inserted in the guide openings 12*a*, a surface of each of the guides 12 parallel to the Z-Y plane is fixed to the internal wall surface of the casing 10*a* via a member which is not shown.

Figure 7:
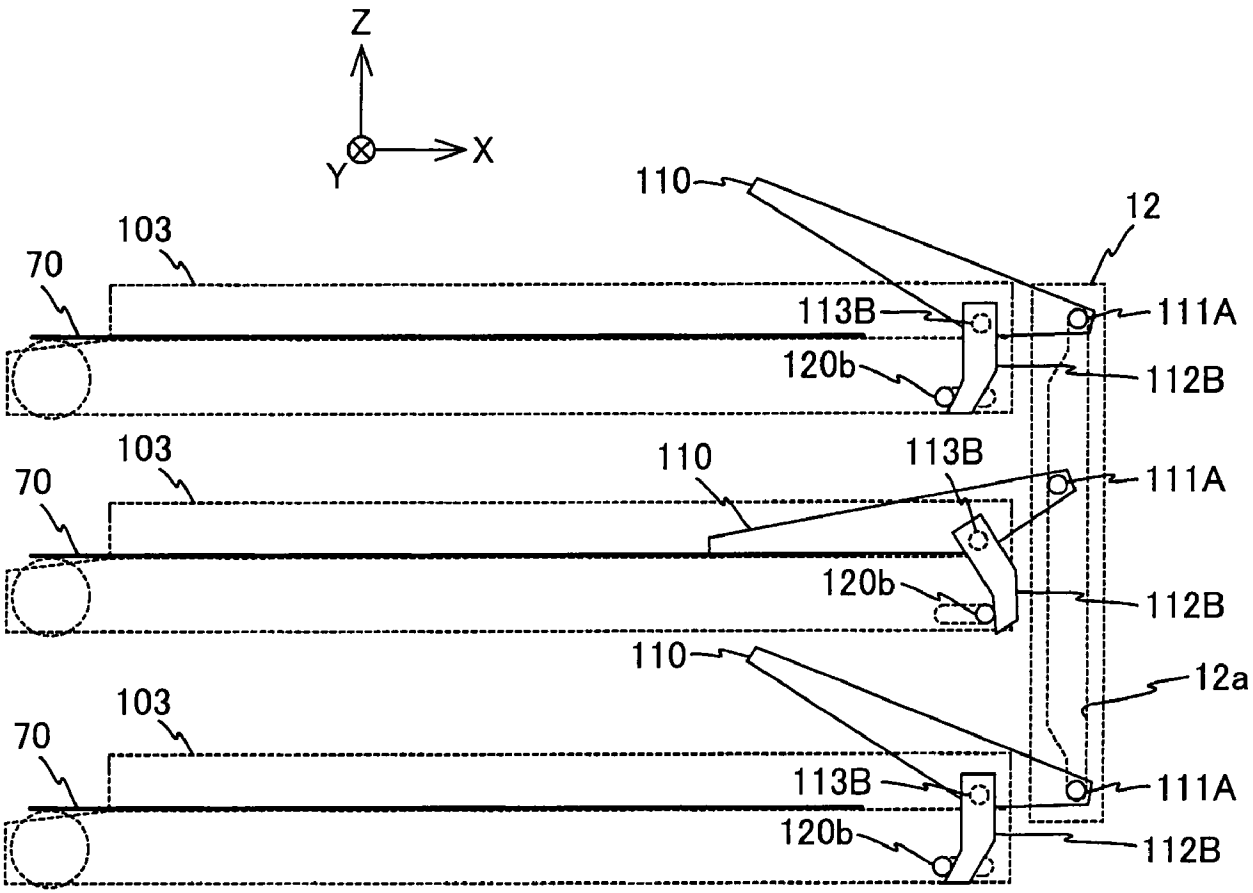
FIG. 7 illustrates an operation of a clamper.

FIG. 7 illustrates the movement of the conveyance tray 103 between the loading position and the unloading position. As shown in FIG. 7, in the conveyance device 100, when the tray 103 is positioned at the loading position (at the bottom) and the unloading position (at the top), the slide shafts 111A and 111B on the lifter 102 are positioned at the upper-end portion and the lower-end portion, respectively, of the guide opening 12*a* formed in the guides 12.

With reference to FIG. 7, an operation of the conveyance device 100 is described.

In the conveyance device 100, as mentioned above, the clamper 110 of the lifter 102 is biased into contact with the conveyance tray 103. Thus, when the conveyance tray 103 is lifted or lowered by the lifting device 101, the slide shafts 111A and 111B fixed to the clamper 110 move along the −X side of the inner edge of the guide opening 12*a*. Thus, as will be seen from FIG. 7, each of the slide shafts 111A and 111B, when moved to the upper end or the lower end of the guide opening 12*a* from its center portion, is drawn toward the +X direction and its position in the X-axis direction is restricted. Therefore, the clamper 110, when the tray 103 is in the loading position or the unloading position, is rotated up about the rotating shafts 113A and 113B. As the clamper 110 is thus rotated up or down, the rotating members 112A and 112B fixed to the rotating shafts 113A and 113B also rotate about the axis at their +Z side ends.

As the rotating members 112A and 112B are rotated, the slide shaft 120*b* of the opening/closing member 120, against which the lower-end portions of the rotating members 112A and 112B abut, is pressed in the −X direction, whereby the sliding members 130A and 130B are moved in the +Y direction and the −Y direction, respectively. As a result, the guide pins 108A, which protrude onto the upper surface of the mount portion 103*a* of the conveyance tray 103 via the guide openings $\mathbf{103}f_A$, are moved in the +Y direction, while the guide pins 108B that similarly protrude via the guide openings $\mathbf{103}f_B$ are moved in the −Y direction.

On the other hand, when the conveyance tray 103 is being lifted or lowered by the lifting device 101 so that the tray 103 is positioned between the loading position and the unloading position, the restriction of the slide shafts 111A and 111B of the clamper 110 is removed, whereby the lower surface of the clamper 110 is pressed against the tray 103. Further, the guide pins 108A and 108B are moved to the −Y direction and the +Y direction, respectively, by the resilience of the springs 15 as the sliding members 130A and 130B are moved to the −Y direction and the +Y direction, respectively.

Thus, in the conveyance device 100, when positioned at the loading position and the unloading position, the clamper 110 is rotated away from the conveyance tray 103, whereby the guide pins 108A and 108B are maximally spaced apart from each other in the Y-axis direction. When the tray 103 is lifted or lowered between the loading position and the unloading position, the clamper 110 is pressed against the conveyance tray 103, whereby the guide pins 108A and 108B are most closely positioned with each other in the Y-axis direction.

An operation of the above-described printer 10 is described based on the assumption that plural sheets of the rewritable medium 70 are contained in the paper-feeding cassette 21, and the tray 22 is biased upwardly by the lifting mechanism 24. The conveyance tray 103 is assumed to be positioned as indicated by the solid lines in FIG. 1, and the individual portions of the printer 10 are controlled centrally by a control unit which is not shown.

<Paper Feeding Step>

The control unit, in response to an operation command from a user or a senior device, rotates the paper feeding roller 23 so that the rewritable medium 70 in the paper feeding cassette 21 is sent in the +X direction. As a result of this, the rewritable medium 70 is conveyed, via the insertion opening 30*a*, between the pair of conveyance rollers 31 of the erasing unit 30.

<Erasing Step>

When the rewritable medium 70 is conveyed to the erasing unit 30, the control unit moves the rewritable medium 70 in the +X direction by using the conveyance rollers 31 and the platen roller 33. In addition, the control unit heats the upper surface of the rewritable medium 70 so as to erase the information recorded therein, using the erasing head 32.

<Loading into the Lifter>

When the rewritable medium 70 is moved in the +X direction and the +X side end of the rewritable medium 70 passes above the conveyance roller 107 of the conveyance tray 103, the control unit causes the movable member 34*a* to rotate in order to make the movable roller 34 come in contact with the upper surface of the rewritable medium 70, so that the rewritable medium 70 can be conveyed to the conveyance tray 103 by the movable roller 34 in cooperation with the conveyance roller 107.

<Conveying Step>

When the rewritable medium 70 is loaded into the conveyance tray 103, the control unit drives the lifting device 101 to lift the conveyance tray 103. This results in the rewritable medium 70, with its edge on the +Y side in contact with the guide pins 108A and its edge on the −Y side with the guide pins 108B, is held between the clamper 110 and the tray 103. Thus, the rewritable medium 70 is held in the conveyance tray 103, with its posture with respect to the conveyance tray 103 and its position with respect to the Y-axis direction adjusted. In the following, the operation is described in greater detail with reference to FIGS. 8A and 8B.

Figure 8A:
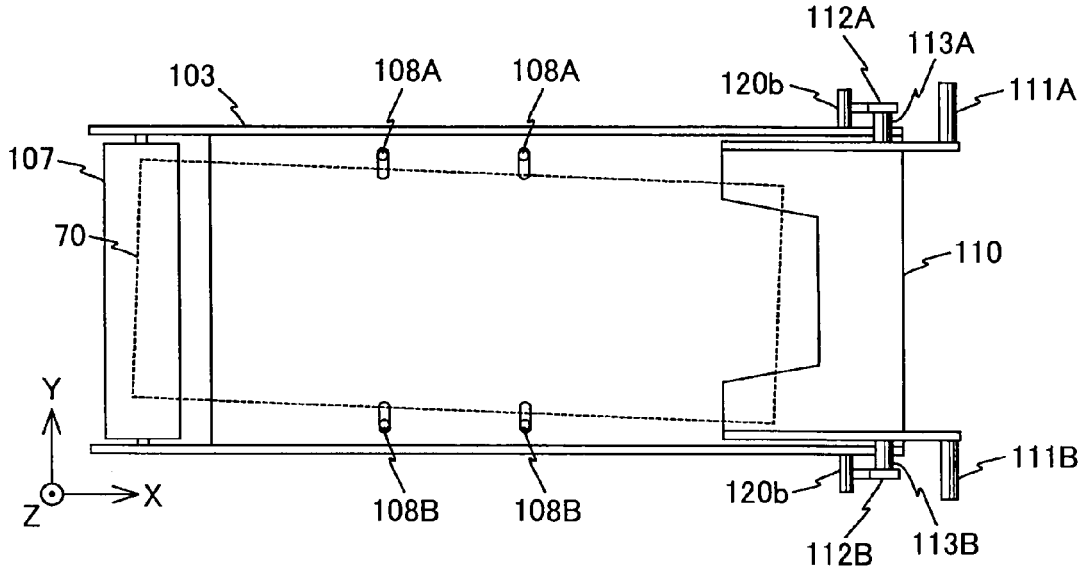
FIG. 8A shows a view illustrating a method of correcting the posture of the rewritable medium.
Figure 8B:
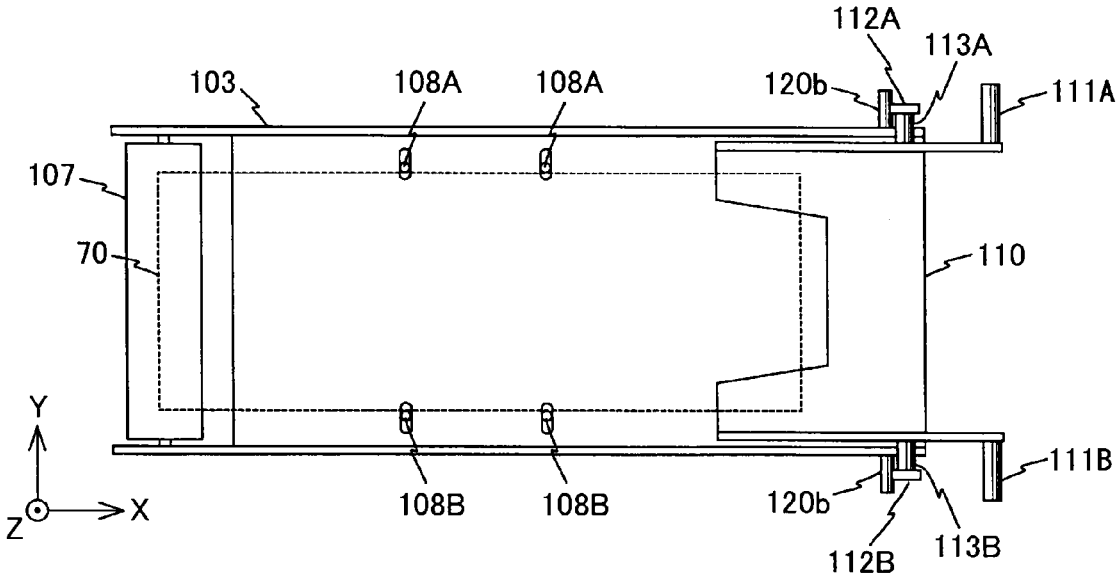
FIG. 8B shows another view illustrating the method of correcting the posture of the rewritable medium.

FIG. 8A shows an example of the rewritable medium 70 that has been loaded into the conveyance tray 103 through the above steps. As shown in FIG. 8A, when loaded into the conveyance tray 103, the rewritable medium 70 may rotate about the Z-axis, or be positioned erroneously with respect to the Y-axis direction, for one reason or another. In the conveyance device 100, in synchronism with the start of lifting of the conveyance tray 103, the guide pins 108A and 108B move toward each other in the Y-axis direction, until they abut against either side edge of the rewritable medium 70, as shown in FIG. 8B. Because the guide pins 108A and 108B are lined in the X-axis direction, any rotation of the rewritable medium 70 is eliminated and its position in the Y-axis direction is adjusted, whereby the development of skew can be eliminated or minimized. Until the conveyance tray 103 is moved to the unloading position, the rewritable medium 70 is sandwiched by the guide pins 108A and 108B, which are biased toward each other by the springs 15, to such an extent as to not warp the rewritable medium 70. At the same time, the rewritable medium 70 is held between the clamper 110 and the conveyance tray 103, thereby limiting the shifting in the posture of the rewritable medium 70. In this way, the development of skew during the movement of the conveyance tray 103 is prevented.

When the lifting of the conveyance tray 103 is completed and the unloading position is reached, the clamper 110 rotates and the guide pins 108A and 108B move, thereby releasing the rewritable medium 70 free with respect to the conveyance tray 103.

<Unloading from the Tray>

When the conveyance tray 103 is positioned at the unloading position, the control unit drives the support member 51*a* to cause the drawing roller 51 to come into contact with the upper surface of the rewritable medium 70, as will be seen from FIG. 1. Then, the control unit causes the drawing roller 51 and the loading/unloading roller 107 to cooperate in conveying the −X side end of the rewritable medium 70 between the recording head 52 and the platen roller 53.

<Printing Step>

When the rewritable medium 70 moves in the −X direction so that a recording start position of the rewritable medium 70 is situated just under the recording head 52, the control unit lowers the recording head 52 so that the rewritable medium 70 is sandwiched by the recording head 52 and the platen roller 53. In addition, the control unit drives the supporting members 51*a* and 54*a* in the upper direction so that the drawing roller 51 and the first discharge roller 54 are withdrawn to a position where the drawing roller 51 and the first discharge roller 54 do not interfere with the rewritable medium 70. The rewritable medium 70 is then moved relative to the recording head 52 by the platen roller 53 alone, and recording of information in the rewritable medium 70 is initiated. In parallel with this operation, the control unit causes the conveyance tray 103 to move to the loading position and stand by.

<Paper Ejection Step>

The rewritable medium 70 in which recording of information is completed is ejected by the first and second discharge rollers 54 and 55 via the ejection opening 50*a* and stacked in the paper discharge tray 60 one sheet after another.

Thus, in accordance with the present embodiment, the guide 12, the slide shafts 111A and 111B, the rotating members 112A and 112B, the opening/closing member 120, the sliding members 130A and 130B, and the guide pins 108A and 108B together make up a skew adjusting mechanism. The guide 12, the slide shafts 111A and 111B, and the clamper 110 together make up a medium pressing mechanism.

As described above, in the printer 10 in accordance with the present embodiment, the rewritable medium 70 from which information has been erased is loaded onto the conveyance tray 103 of the conveyance device 100. During the conveyance of the rewritable medium 70 to the recording unit 50, the rotation of the rewritable medium 70 and its position in the Y-axis direction are adjusted. Until the conveyance tray 103 moves to the unloading position, the rewritable medium 70 is sandwiched by the guide pins 108A and 108B only to such an extent as to not warp, while the rewritable medium 70 is held between the clamper 110 and the conveyance tray 103. Thus, the shifting in the posture of the rewritable medium 70 is regulated. In this way, the rewritable medium 70 can be supplied to the recording unit 50 with its posture adjusted, so that the recording unit 50 can record information in the rewritable medium 70 without development of skew.

Because the clamper 110 and the guide pins 108A and 108B are operated in mechanical linkage with the lifting or lowering of the conveyance tray 103, there is no need to provide separate drive systems for the clamper 110 or the guide pins 108A and 108B. The posture of the rewritable medium 70 can also be controlled easily.

While the foregoing embodiment involves the recording of information in the rewritable medium 70 using the printer 10, any type of thermosensitive recording medium capable of recording and erasing information may be used, such as a thermosensitive recording sheet. The material of the thermosensitive recording medium may be selected as desired depending on a particular embodiment.

The thermal characteristics of the rewritable medium 70 shown in FIG. 3 are merely an example and other thermal characteristics may be employed. In this case, the heating temperature of the erasing unit 30 or the recording unit 50 may be appropriately set.

The erasing unit 30 is not necessarily required. When no erasing unit is used, new or erased sheets of a recording medium may be contained in the paper-feeding cassette 21, and the sheets may be conveyed to the recording unit 50 by the conveyance tray 103. The recording medium may not be of the thermosensitive type.

Thus, the information recording apparatus according to various embodiments of the invention can be suitably used for recording information in a thermosensitive recording medium.

Although this invention has been described in detail with reference to certain embodiments, variations and modifications exist within the scope and spirit of the invention as described and defined in the following claims.

The present application is based on the Japanese Priority Application No. 2007-235656 filed Sep. 11, 2007, the entire contents of which are hereby incorporated by reference.

What is claimed is:

1. An information recording apparatus for recording information in a thermosensitive recording medium that exhibits and loses a color in a thermally reversible manner, the information recording apparatus comprising:

an erasing unit configured to erase information recorded in the thermosensitive recording medium;

a recording unit configured to record information in the thermosensitive recording medium from which information is erased by the erasing unit;

a moving body configured to move between the erasing unit and the recording unit with the thermosensitive recording medium placed on the moving body; and a skew adjusting mechanism configured to eliminate or reduce a tilting of the thermosensitive recording medium placed on the moving body with respect to the moving body.

2. The information recording apparatus according to claim 1, wherein the skew adjusting mechanism includes a first abutting portion that moves relative to the moving body and abuts on an outer edge of the thermosensitive recording medium at least on one side thereof, in order to eliminate or reduce the tilting of the thermosensitive recording medium with respect to the moving body.

3. The information recording apparatus according to claim 2, wherein the skew adjusting mechanism includes a second abutting portion that abuts on an outer edge of the thermosensitive recording medium on the other side thereof in order to eliminate or reduce the tilting of the thermosensitive recording medium with respect to the moving body.

4. The information recording apparatus according to claim 2, further comprising:

a driven portion that moves with the moving body;

a guide portion configured to move the driven portion relative to the moving body while changing the direction of movement of the driven portion when the moving body moves near the erasing unit or the recording unit; and a driven section configured to move the abutting portion in accordance with the movement of the driven portion.

5. The information recording apparatus according to claim 1, further comprising a medium pressing mechanism configured to press the thermosensitive recording medium onto the moving body.

6. The information recording apparatus according to claim 5, wherein the medium pressing mechanism includes an up/down portion configured to, in mechanical linkage with the movement of the driven portion relative to the moving body, assume a spaced-apart posture in which the up/down portion is spaced apart from the moving body, or a pressing posture in which the up/down portion presses the thermosensitive recording medium onto the moving body, wherein the up/down portion assumes the pressing posture when the moving body is conveyed from the erasing unit to the recording unit.

7. An information recording apparatus for recording information in a sheet-like recording medium, comprising:

a recording unit configured to record information in the recording medium;

a moving body configured to move from a predetermined position to the recording unit with the recording medium placed on the moving body; and a skew adjusting mechanism configured to eliminate or reduce a tilting of the recording medium placed on the moving body with respect to the moving body.

* * * * *